US006124558A

United States Patent [19]

Baumeister et al.

[11] Patent Number: 6,124,558

[45] Date of Patent: Sep. 26, 2000

[54] ROTATION-ACTIVATED CIRCUIT-BREAKER WITH A LEADING AUXILIARY SWITCH

[75] Inventors: Rudolf Baumeister, Hennef; Peter Willerscheidt, Remagen; Guenter Baujan, Troisdorf, all of Germany

[73] Assignee: Moeller GmbH, Bonn, Germany

[21] Appl. No.: 09/424,203

[22] PCT Filed: Mar. 9, 1999

[86] PCT No.: PCT/EP99/01508

§ 371 Date: Nov. 19, 1999

§ 102(e) Date: Nov. 19, 1999

[87] PCT Pub. No.: WO99/49490

PCT Pub. Date: Sep. 30, 1999

[30] Foreign Application Priority Data

Mar. 21, 1998 [DE] Germany ..... 198 12 503

[51] Int. Cl.[7] ..... H01H 3/40

[52] U.S. Cl. ..... 200/501; 219/719

[58] Field of Search ..... 200/501; 171/242; 219/719

[56] References Cited

U.S. PATENT DOCUMENTS 5,129,272 7/1992 Irvin ..... 74/63

6,057,533 5/2000 Ahn ..... 219/719

FOREIGN PATENT DOCUMENTS 0 219 570 4/1987 European Pat. Off. .

0 823 720 2/1998 European Pat. Off. .

2 617 331 12/1988 France .

43 17 656 1/1994 Germany .

2 306 053 4/1997 United Kingdom .

*Primary Examiner*—Michael L. Gellner

*Assistant Examiner*—Nhung Nguyen

*Attorney, Agent, or Firm*—Kenyon & Kenyon

[57] ABSTRACT

A rotation activated circuit breaker with a leading auxiliary switch, in which the auxiliary contacts of the auxiliary switch are actuated before the main contacts. An actuator element is provided, which contains a drive pinion that is rotation actuated by an actuating mechanism and a longitudinally movable first gear rack, which engages with the drive pinion and actuates the auxiliary switch. Furthermore, a second gear rack, which lags behind the first gear rack in the closing direction, and an output pinion, assigned to the second gear rack, which is connected to a drive shaft for the breaking mechanism of the circuit breaker, are provided. The tooth pitch of the output pinion and the second gear rack is greater than the tooth pitch of the drive pinion and the first gear rack so that the total rotation angle of the drive pinion and output pinion is the same over the full closing motion of the actuating mechanism.

14 Claims, 4 Drawing Sheets

ROTATION-ACTIVATED CIRCUIT-BREAKER WITH A LEADING AUXILIARY SWITCH

FIELD OF THE INVENTION

The present invention relates to a rotation activated circuit breaker, in particular a motor circuit breaker or power circuit breaker having a leading auxiliary switch, with the auxiliary contacts of the auxiliary switch being actuated before the main contacts when the circuit breaker is closed. Such a leading interaction between auxiliary contacts and main contacts may be used for advance querying about additional closing conditions, for example, querying about a previous emergency shutoff of an electrical system via an undervoltage fuse.

BACKGROUND OF THE INVENTION

German Patent No. 43 17 656 C2 describes a key-actuated circuit breaker having a leading auxiliary switch, in which the auxiliary switch is arranged as a pre-switch between the turn-on key and the switching contact, with an increased opening path compared to the stroke of the turn-on key being achieved for the main contacts using a rocker or transfer lever for the auxiliary contacts. This method cannot be used for rotation activated circuit breakers, in which the main contacts are actuated by a rotary actuating mechanism via a breaker mechanism. In such circuit breakers, there is also the danger of creeping contact actuation of the auxiliary switch, which may result in uncontrollable contact overlaps between main contacts and auxiliary contacts when interacting with an undervoltage fuse, for example.

SUMMARY OF THE INVENTION

An object of the present invention is therefore to ensure leading actuation of the auxiliary switch for all applications without having to take into consideration the The present invention provides a rotation activated circuit breaker comprising a leading auxiliary switch, an actuating element, a breaking element, and an actuator element disposed between the actuating mechanism and the breaking mechanism. The actuator element includes: a drive pinion having a first tooth pitch, the drive pinion being rotatably actuated by the actuating mechanism; a first gear rack having a second tooth pitch, the first gear rack being longitudinally maneuverable in a closing direction, and engageable with the drive pinion, the first gear rack being capable of actuating the auxiliary switch; a second gear rack having a third tooth pitch, the second gear rack being longitudinally maneuverable in a closing direction, the second gear rack connected to the first gear rack so as to lag behind the first rack in the closing direction; and an output pinion having a fourth tooth pitch engageable with the second gear rack, the output pinion being connected to a drive shaft for the breaking mechanism; the third and fourth tooth pitches being greater than the first and second tooth pitches so that a respective total angle of rotation of each of the drive pinion and output pinion is equal over a full closing motion of the actuating mechanism.

The first gear rack directly actuated by the auxiliary switch is immediately moved longitudinally by the closing motion of the drive pinion, while the second gear rack, due to the fact that it lags behind and has a greater tooth pitch, drives the output pinion with a time lag and also with a higher rotation speed with respect to the drive pinion. Thus, in a first angular section of the closing motion, only the auxiliary switch is actuated, leading with respect to the breaker mechanism of the circuit breaker, and in the remaining angular section the entire closing motion of both of these angular sections is transmitted to the breaker mechanism with a certain transmission ratio. The method according to the present invention achieves closing of the auxiliary switch clearly before the breaker mechanism, with the entire actuating angle being available again for the subsequent closing of the breaker mechanism and switching of the main contacts. Thus no changes are required in the breaker mechanism, i.e., the main contact drive.

A well-defined initial position of the gear racks and thus of the actuating element in the opening position is, for example achieved be a spring means, in particular by a compression spring, directly or indirectly acting upon the first gear rack. The axially non-offset arrangement of both pinions is useful. Exemplary refinements concerning the lagging connection of the gear racks include a uniform gear rack body with gear racks offset in the direction of motion or a pull connection provided between the two gear racks via a driver pin and a longitudinal driver orifice. The directions of motion and the planes of motion of the gear racks may be, for example offset in parallel. An exemplary embodiment concerning the actuation of the auxiliary switch has a run-off bevel on the first gear rack. The pinions may be, for example peripherally toothed only to the extent of their total rotational angles. Stops on the pinions and a corresponding stationary stop of the actuator element may be used to ensure correct angular positioning of the two pinions with respect to one another and with respect to the position of the gear racks as the actuator element is installed. The present invention may, for example include the auxiliary switch and/or an undervoltage fuse as additional add-on components. The finger-grip knob to be removed from the circuit breaker or the output means of a remote drive may be, for example placed on the drive pinion of the actuator element.

BRIEF DESCRIPTION OF THE DRAWINGS

Further details and advantages of the present invention are derived from the embodiments illustrated in the drawings, in which.

DETAILED DESCRIPTION

Figure 1:
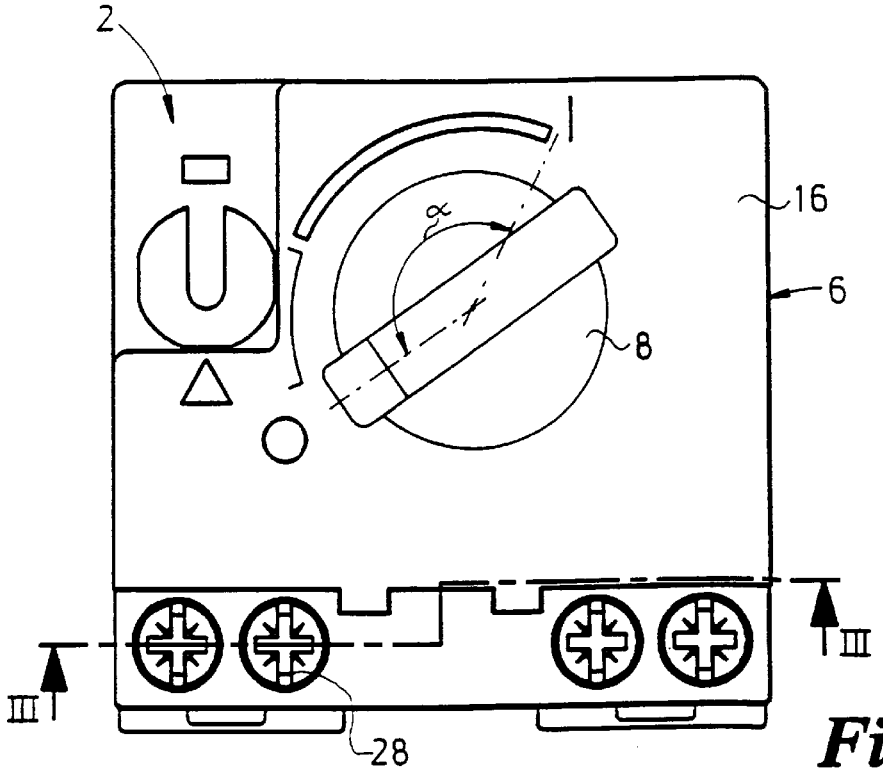
FIG. 1 shows a top view of a first embodiment of the actuator element according to the present invention.
Figure 2:
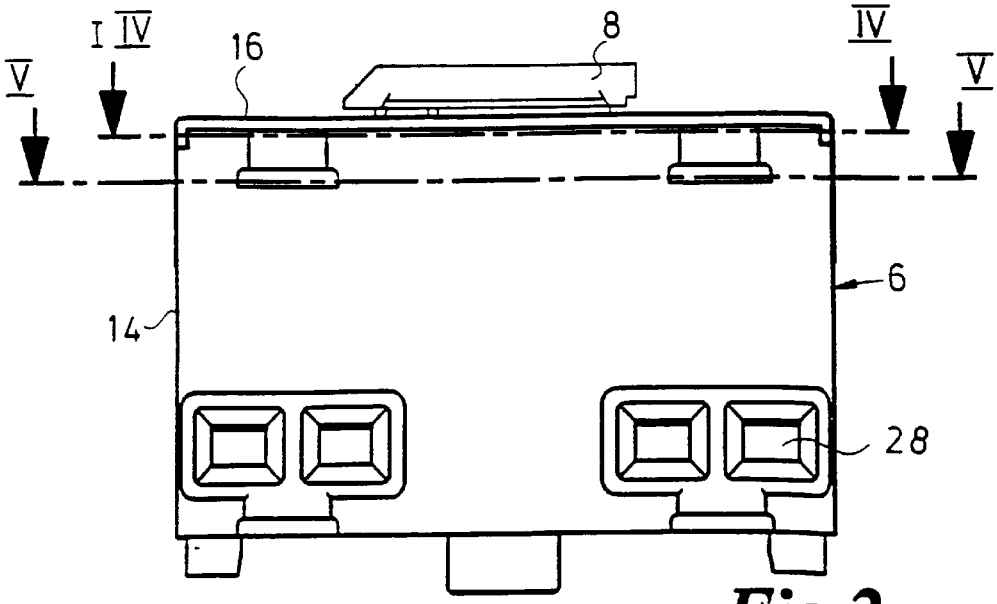
FIG. 2 shows a front view of the actuator element of FIG. 1.
Figure 3:
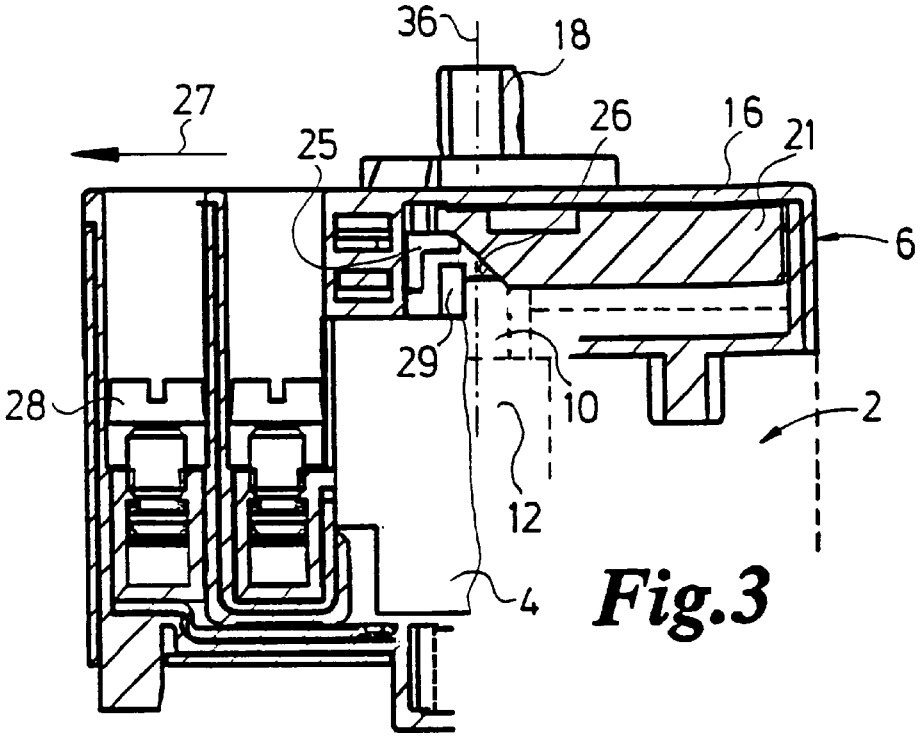
FIG. 3 shows a partial section view along section line III—III of FIG. 1.
Figure 4:
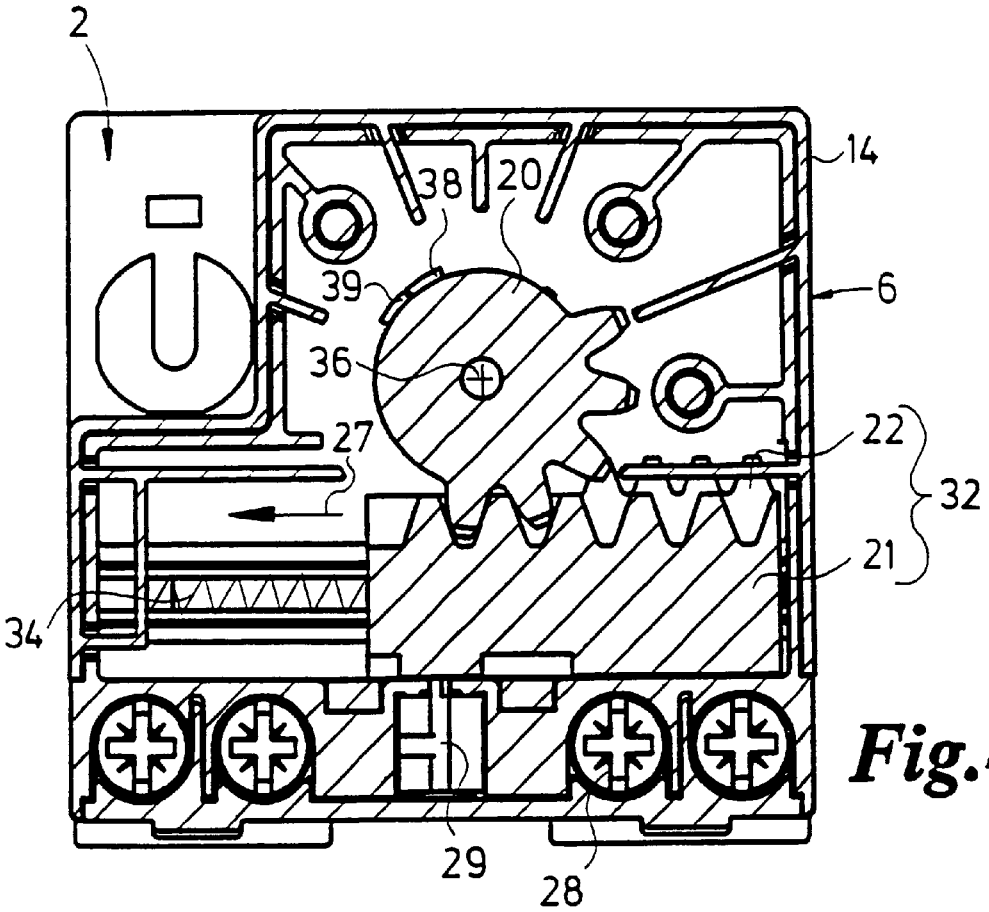
FIG. 4 shows a sectional view according to section line IV—IV of FIG. 2.
Figure 5:
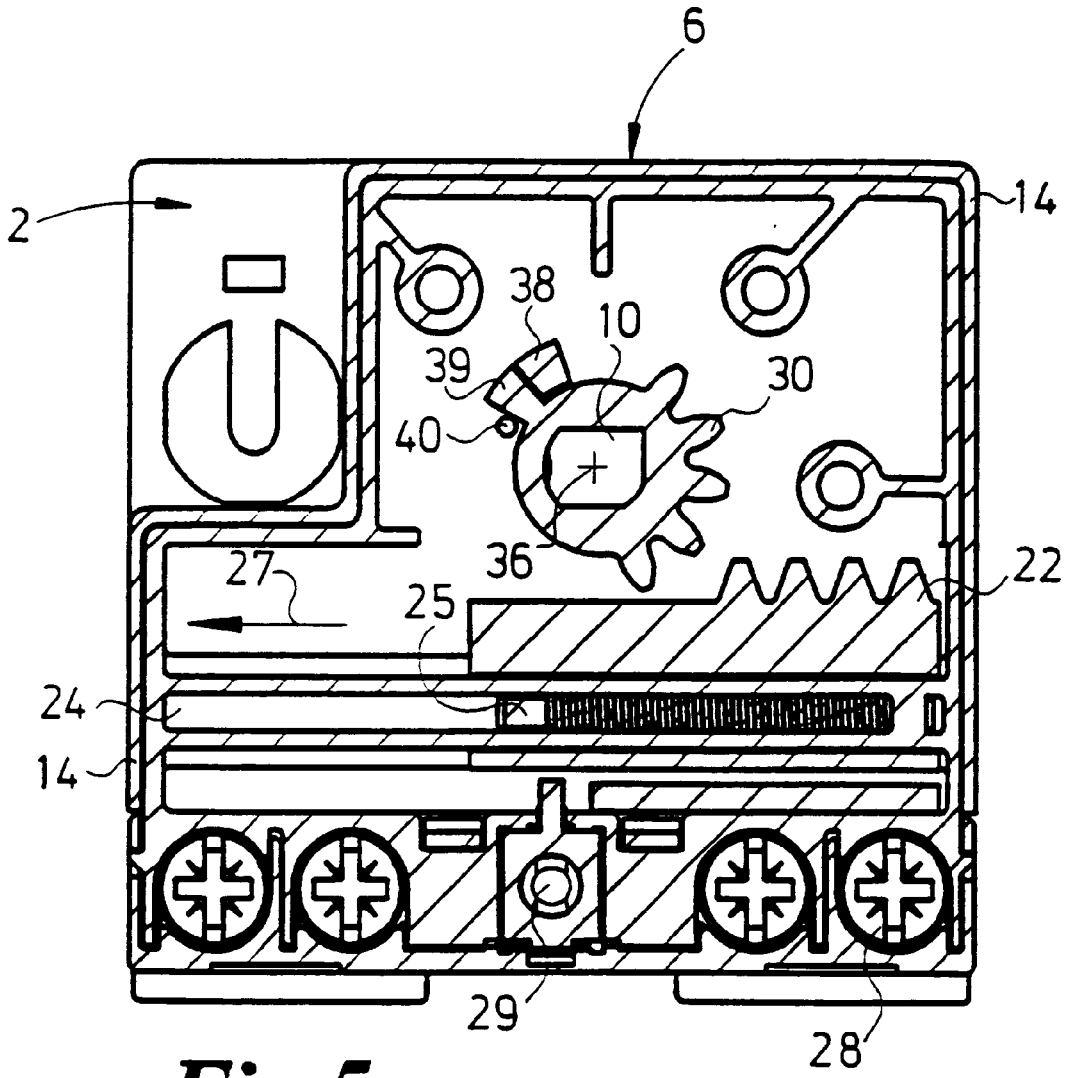
FIG. 5 shows a sectional view according to section line V—V of FIG. 2.

According to a first exemplary embodiment illustrated in FIGS. 1 through 5, a rotation activated circuit breaker 2 is provided with a leading auxiliary switch 4. An actuator element 6 is arranged between an actuating mechanism 8 and a drive shaft 10 for a breaker mechanism 12 of circuit breaker 2. Actuator element 6 is designed as an add-on component to be installed on the front of circuit breaker 2 and is surrounded by a molded housing having a bottom part 14 and a top part 16 mounted thereon. After actuating mechanism 8, designed as a finger-grip knob, is removed from drive shaft actuator element 6 is screwed onto circuit breaker 4 together with bottom part 14. The actuator element contains a drive pinion 20, rotationally actuated by actuating mechanism 8 via a drive shaft 18. A first gear rack 21 and a second gear rack 22 are designed as a single gear rack body 32, offset with respect to each other in the closing direction 27 and arranged perpendicularly to their direction of movement. First gear rack 21 engages drive pinion 20 and is glidingly positioned in bottom part 14 with the help of a guide element 25, which slides in a longitudinal guide slot 24. First gear rack 21 actuates auxiliary switch 4, arranged with its terminals 28 in actuator element 6. For this purpose, it has a run-off bevel 26, which interacts with switching plunger 29 of auxiliary switch 4 when it moves 21 in the closing direction 27. Second gear rack 22 is assigned to an output pinion 30, which is connected to drive shaft 10 for breaker mechanism 12. The tooth pitch of output pinion 30 and second gear rack 22 is greater than that of drive pinion 20 and first gear rack 21 so that the total angles of rotation $\alpha$ of drive pinion 20 and output pinion 30 are the same over the full closing motion of actuating mechanism 8. A spring means 34, designed as a compression spring, is supported between bottom part 14 and first gear rack 21, whereby a well-defined initial position of gear racks 21, 22 and thus of actuating mechanism 8 in the open position is achieved. Drive pinion 20, viewed from the front, is arranged in front of, and on the same axis of rotation 36 as, output pinion 30, which has a circular design and is mounted in a circular recess in the center of bottom part 14, and drive pinion 20, having a circular design, being mounted in another circular recess in the center of output pinion 30. Thus actuating mechanism 8 and drive shaft 10 are flush in the same manner as in the case of circuit breaker 2 without actuator element 6. It can be seen that drive pinion 20 and output pinion 30 have peripheral teeth only to the extent that they engage first and second gear racks 21 and 22, respectively. In order to ensure a correct angular position of drive pinion 20 and output pinion 30 with respect to gear racks 21 and 22, a first stop 38 is formed on drive pinion 20 and a second stop 39 is formed on output pinion 30, which interact with a counterstop 40 formed on bottom part 14 in that the rotation of output pinion 30 in a counterclockwise direction is limited by the contact of second stop 39 with counterstop 40 and the rotation of drive pinion 20 in the same direction is limited by the contact of first stop 38 with second stop 39.

When circuit breaker 2 is closed via actuating mechanism 8, the above-described actuator element 6 works as follows: First gear rack 2 1, which directly actuates auxiliary switch 4, is moved first in the direction of closing 27 by the rotational closing motion of drive pinion 20, whereas second gear rack 22 drives output pinion 30 with a time lag, due to its offset with respect to first gear rack 21, but then with an increased rotation speed due to its higher tooth pitch compared to first gear rack 21. Thus in a first angular section of the closing motion of actuating mechanism 8, only auxiliary switch 4 is actuated before breaking mechanism 12, and in the remaining angular section, the total rotation angle a is transmitted to breaking mechanism 12 with a certain transmission ratio.

Figure 6:
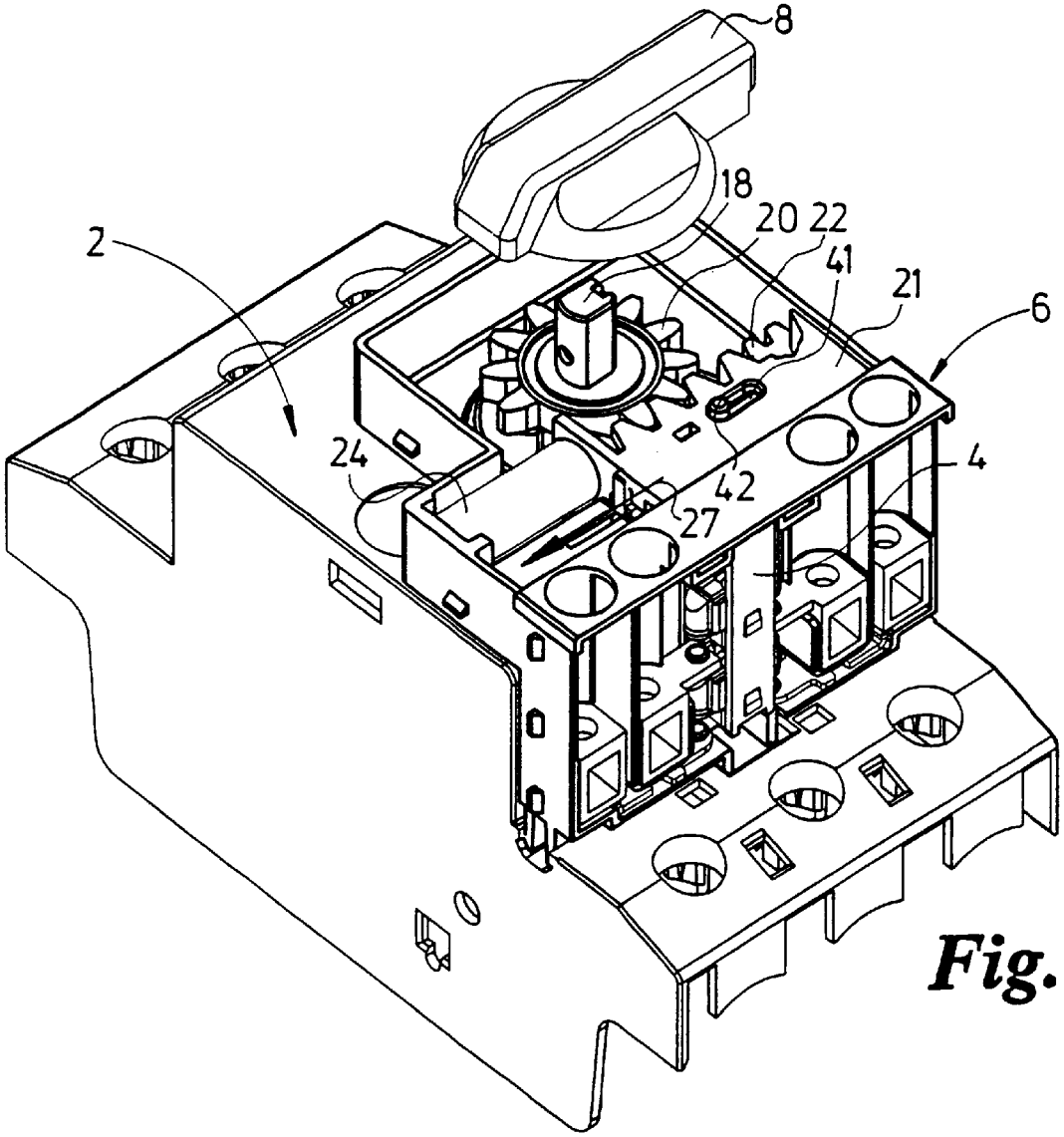
FIG. 6 shows a cutaway perspective view of the second embodiment of the actuator element according to the present invention.

A second exemplary of actuator element 6, shown in FIG. 6, is mounted on open circuit breaker 2, which is only partially shown; actuating mechanism 8 is shown removed from drive shaft 18 of drive pinion 20. This embodiment differs from the one described above, for example in that the first and second gear racks 21 and 22, respectively, are arranged so that they can be displaced with respect to one another in parallel, and a driver pin 42, connected to second gear rack 22, engages in a longitudinal driver orifice 41, provided in first gear rack 21. Due to this pull connection, second gear rack 22 will lag behind first gear rack 21 in closing direction 27 in the first phase of the closing motion in order to actuate the contacts of the leading auxiliary switch 4 before the main contacts of circuit breaker 2 are actuated.

The present invention is not limited to the embodiments described above, but also includes all embodiments functioning in the same manner in the sense of the invention. Thus, for example, the invention can also be implemented with an actuating mechanism that is not a manually actuated rotary knob as described above, but an output mechanism that is part of a remote drive to be installed upstream from the circuit breaker.

What is claimed is:

1. A rotation activated circuit breaker comprising:

a leading auxiliary switch;

an actuating element;

a breaking element; and an actuator element disposed between the actuating mechanism and the breaking mechanism, the actuator element including:

a drive pinion having a first tooth pitch, the drive pinion being rotatably actuatable by the actuating mechanism;

a first gear rack having a second tooth pitch, the first gear rack being longitudinally maneuverable in a closing direction and engageable with the drive pinion, the first gear rack being capable of actuating the auxiliary switch;

a second gear rack having a third tooth pitch, the second gear rack being longitudinally maneuverable in the closing direction, the second gear rack connected to the first gear rack so as to lag behind the first rack in the closing direction; and an output pinion having a fourth tooth pitch engageable with the second gear rack, the output pinion being connected to a drive shaft for the breaking mechanism;

the third and fourth tooth pitches being greater than the first and second tooth pitches so that a respective total angle of rotation of each of the drive pinion and output pinion is equal over a full closing motion of the actuating mechanism.

2. The rotation activated circuit breaker as recited in claim 1 further comprising a spring element, the spring element acting upon the actuator element in a direction opposite to the closing direction.

3. The rotation activated circuit breaker as recited in claim 1 wherein the drive pinion and the output pinion are disposed on a same axis of rotation.

4. The rotation activated circuit breaker as recited in claim 1 wherein the first and second gear racks are offset with respect to one another in the closing direction and form a single gear rack body.

5. The rotation activated circuit breaker as recited in claim 1 wherein the first and second gear racks are disposed so as to be displaceable in parallel with one another, and wherein the first gear rack includes a longitudinal driver orifice extending in the closing direction and the second gear rack includes a driver pin for engaging the longitudinal driver orifice, or the second gear rack includes a longitudinal driver orifice extending in the closing direction and the first gear rack includes a driver pin for engaging the longitudinal driver orifice.

6. The rotation activated circuit breaker as recited in claim 1 wherein the first and second gear racks are each disposed perpendicularly to a respective plane of motion.

7. The rotation activated circuit breaker as recited in claim 1 wherein the first gear rack includes a run-off bevel disposed so as to interact with the auxiliary switch.

8. The rotation activated circuit breaker as recited in claim 1 wherein the drive pinion and the output pinion are toothed only on that part of their peripheries required for the full closing motion.

9. The rotation activated circuit breaker as recited in claim 1 wherein the actuator element includes a stationary counterstop and the drive pinion and the output pinion each include a stop for positioningly interacting with the stationary counterstop.

10. The rotation activated circuit breaker as recited in claim 1 wherein the auxiliary switch includes first terminals, the auxiliary switch being disposed in the actuator element.

11. The rotation activated circuit breaker as recited in claim 1 further comprising an undervoltage fuse including second terminals, the undervoltage fuse being disposed in the actuator element.

12. The rotation activated circuit breaker as recited in claim 1 wherein the actuator element is disposed on a front side of the circuit breaker.

13. The rotation activated circuit breaker as recited in claim 12 wherein the actuating mechanism includes a removable rotary knob.

14. The rotation activated circuit breaker as recited in claim 12 wherein the actuating mechanism includes an output of a remote drive.

* * * * *